US005268118A

United States Patent [19]

Bloodworth et al.

[11] Patent Number: 5,268,118

[45] Date of Patent: Dec. 7, 1993

[54] ELECTROVISCOUS LIQUIDS BASED ON POLYMER DISPERSIONS WITH AN ELECTROLYTE-CONTAINING DISPERSE PHASE

[75] Inventors: Robert Bloodworth, Cologne; Günther Penners; Günter Oppermann, both of Leverkusen; Roland Flindt, Cologne, all of Fed. Rep. of Germany

[73] Assignee: Bayer Aktiengesellschaft, Leverkusen, Fed. Rep. of Germany

[21] Appl. No.: 745,586

[22] Filed: Aug. 15, 1991

[30] Foreign Application Priority Data

Aug. 25, 1990 [DE] Fed. Rep. of Germany ..... 4026881

[51] Int. Cl.[5] ..... C10M 171/00; C10M 169/04

[52] U.S. Cl. ..... 252/73; 252/74; 252/572

[58] Field of Search ..... 252/73, 74, 572

[56] References Cited

U.S. PATENT DOCUMENTS

| | | | |
|---|---|---|---|
| 3,970,573 | 7/1976 | Westhaver | 252/73 |
| 4,702,855 | 10/1987 | Goosens et al. | 252/75 |
| 4,812,251 | 3/1989 | Stangroom | 252/75 |

FOREIGN PATENT DOCUMENTS

| | | |
|---|---|---|
| 0219751 | 4/1987 | European Pat. Off. . |
| 0284268 | 9/1988 | European Pat. Off. . |
| 0342041 | 11/1989 | European Pat. Off. . |
| 0432601 | 6/1991 | European Pat. Off. . |
| 1-266191 | 10/1989 | Japan . |
| 2-206692 | 8/1990 | Japan . |
| 3-035095 | 2/1991 | Japan . |

OTHER PUBLICATIONS

Matsepuro, "Structure Formation in an Electric Field and the Composition of Electrorheological Suspensions", Translated from Elektroreol. Issled Pril, Minsk, pp. 27–51, 1981.

*Primary Examiner*—Christine Skane

*Attorney, Agent, or Firm*—Sprung Horn Kramer & Woods

[57] ABSTRACT

The present invention relates to electroviscous liquids consisting essentially of (I) a polymer or polymer mixture, (II) an electrolyte dissolved in (I),.

(III) optionally an additive miscible with the solution of (I) and (II), (IV) optionally a viscosity-increasing additive reacting with (I);

(V) a dispersant and (VI) a non-aqueous dispersion medium.

7 Claims, 3 Drawing Sheets

ELECTROVISCOUS LIQUIDS BASED ON POLYMER DISPERSIONS WITH AN ELECTROLYTE-CONTAINING DISPERSE PHASE

BACKGROUND OF THE INVENTION

This invention relates to an electroviscous liquid which undergoes an increase in viscosity on application of a voltage.

Electroviscous liquids (EVLs) are dispersions of fine-particle solids in hydrophobic and electrically non-conductive oils of which the viscosity may be increased very quickly and reversibly from the liquid to the plastic or solid state under the effect of a sufficiently strong electrical field. Their viscosity responds both to electrical d.c. fields and to a.c. fields, the current flowing through the EVL having to be extremely low. Accordingly, EVLs may be used for any applications in which it is desired to control the transmission of powerful forces by low electric power levels, for example in clutches, hydraulic valves, shock absorbers, vibrators or systems for positioning and holding workpieces in position.

In addition to the requirements which an EVL generally has to satisfy, such as a good electroviscous effect, high temperature stability and chemical stability, the abrasiveness and sedimentation stability behavior of the disperse phase play an important part in practical application. Ideally, the disperse phase should not sediment, but at all events should be readily redispersible and should not cause any abrasion under extreme mechanical stressing.

In qualitative terms, the increase in viscosity which an EVL undergoes on application of an electrical field may be explained as follows: the colloidally stable disperse particles polarize in the electrical field and agglomerate through dipole interaction in the direction of the field, resulting in the increase in viscosity. The agglomeration is reversible: if the electrical field is switched off, the particles redisperse and viscosity is reduced to the original value. The polarizability of the disperse phase is thus an important requirement for the development of an electroviscous effect. For this reason, ionically or electronically conductive materials are often used as the disperse phase.

In some of the EVLs corresponding to the prior art, the disperse phase consists of organic solids, such as for example saccharides (DE 2 530 694), starch (EP 2 842 268 A2, U.S. Pat. No. 3,970,573), polymers (EP 150 994 A1, DE 3 310 959 A1, GB 1,570,234, U.S. Pat. No. 4,129,513, ion exchanger resins (JP 92 278/975, JP 31 221/1985, U.S. Pat. No. 3,047,507) or silicone resins (DE 3,912 888 A1). However, inorganic materials have also been used, including for example Li hydrazine sulfate (U.S. Pat. No. 4,772,470 A), zeolites (EP 265 252 A2), silica gel (DE 3 517 281 A1, DE 3 427 499 A1) and aluminium silicates (DE 3 536 934 A1).

In the case of the substances mentioned, the electroviscous effect is attributable to the charging of the solids with water. Small water contents increase ionic conductivity and hence the polarizability of the disperse particles which is essential to the development of the effect. However, water-containing systems show poor chemical stability. In addition, the temperature range in which these liquids can be used is limited.

In the case of other electroviscous liquids, efforts have been made to overcome the disadvantages mentioned by replacing the water-containing disperse phase with a substantially water-free, electronically conductive phase which consists of partly coated, finely disperse metals, such as for example aluminium (JP 016 093, JP 0117 2496), or dielectrics, such as for example $TiO_2$ (SU 715 596), $CaTiO_3$ or $BaTiO_3$ (JP 53/17585), hydrolyzates of metal alkoxides (EP 341 737) or hollow glass bodies (J 0117 2496). However, due to the hardness of the dispersed particles, the described EVLs are abrasive and, hence, are of only limited use for practical applications involving high shear stressing. Carbon-black-filled bead polymers (JP 016 093) or conductive polymers, such as for example polypyrrole or polyacetylene (JP 0126 0710), have also been discussed as substitutes for the water-containing phase.

With the water-containing systems, the optimal properties of the disperse phase can be effectively established by variation of the water content or by modification of the solid matrix. Thus, DE 2 802 494 C2 describes an improvement in the electroviscous effect by introduction of free or neutralized acid groups into a water-containing polymeric phase. In the production of EVLs based on electronically conductive disperse phases, the dispersion particles often had to be aftertreated because of the high electrical conductivity of the starting materials. Thus, JP 016 093 describes the passivation of carbon-black-filled bead polymers by subsequent coating of the polymer particles with polyvinylidene fluoride. However, production costs are greatly increased by aftertreatments of the type in question.

The above-mentioned EVLs corresponding to the prior art are generally produced by dispersion of a solid in a dispersion medium, such as for example halogen-free or halogenated hydrocarbons, aromatic hydrocarbons or silicone oil. The viscosity of the suspension formed depends upon the shape and size or size distribution of the dispersed particles and upon the solids concentration and dispersion effect of any dispersion aids used. High volume-related solids contents for low viscosities are difficult to achieve where non-spherical particles are used.

The problem addressed by the present invention was to provide a water-free, non-abrasive, non-sedimenting EVL having good electroviscous properties which would be distinguished by a low basic viscosity despite a high content by volume of disperse phase.

DESCRIPTION OF THE INVENTION

It has been found that electroviscous liquids of the type in question can be produced on the basis of anhydrous polymers containing dissolved electrolyte. The electroviscous properties of these liquids can be adjusted as required over wide ranges through the type and concentration of the electrolyte. In addition, the electroviscous dispersions according to the invention are water-free and show high dielectric strength. Another advantage to be emphasized is that the described EVLs are sedimentation-stable and non-abrasive and show low basic viscosities, despite high contents by volume of disperse phase. The dispersion polymerization of electrolyte-containing monomers is a particularly suitable process for the production of the EVLs according to the invention. Polymerization should preferably be carried out in the dispersion medium, which also represents the continuous phase of the EVLs, because this eliminates the need for subsequent redispersion.

The EVLs according to the invention essentially contain the following substances in the disperse phase: (I) a polymer or polymer mixture, (II) a dissolved electrolyte and, optionally, (III) an additive miscible with the solution of (I) and (II).

The mixture of substances or its starting products are referred to hereinafter as the starting material. The starting material, which is dispersed in the non-conductive liquid during production of the EVLs, should preferably be present in liquid form. The starting material may optionally be chemically modified by the addition of suitable reagents (IV) before, during or after the dispersion step. This modification influences the consistency of the disperse phase in the final EVL by partial or complete reaction of the functional groups in the starting material.

To avoid coalescence where liquid phases are used, a suitable dispersant (V) is used in the dispersion step. The size of the dispersed particles in the EVLs according to the invention is between 0.1 and 200 μm. The viscosity of the EVLs at room temperature is between 3 and 5,000 cp, depending on the composition of the liquid and the basic viscosity of the dispersion medium.

The EVLs according to the invention essentially contain the following substances in the disperse phase: (I) a polymer, (II) a dissolved electrolyte and, optionally, (III) an additive miscible with the solution of (I) and (II).

DETAILED DESCRIPTION

Figure 1:
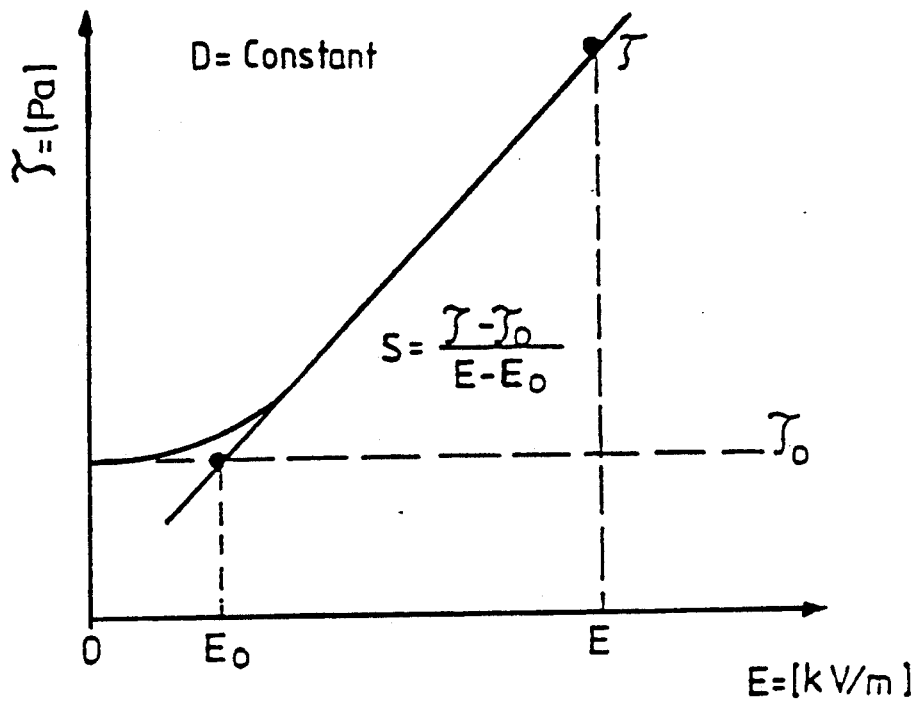

Suitable polymers (I) are, in principle, any substances which show electrolyte solubility, such as for example linear or crosslinked polyethers or copolymers thereof, polyethylene adipate, polyethylene succinate and polyphosphazene. However, polyethers or polymers which can be prepared by crosslinking of difunctional or trifunctional polyether oligomers are particularly preferred. Examples of linear polyether oligomers are polyethylene glycols, polypropylene glycols, statistical ethylene/propylene glycol copolymers or even ethylene glycol/propropylene glycol block copolymers, for example of the type marketed by GAF under the name "Pluronic". Branched polyether oligomers are, for example, tris(polypropylene oxide)ω-ol)glycidyl ethers or other substances obtained by ethoxylation of propoxylation of hydroxy compounds of relatively high functionality, such as for example pentaerythritol or 1,1,1-trimethylol propane. The molecular weight of the glycols is between 62 and 1,000,000 and preferably between 100 and 10,000. The oligomers may optionally contain terminal groups. Amines, allyl or vinyl groups or even carboxyl groups are examples of functional terminal groups. Polyethylene or polypropylene monoamines or diamines are marketed by TEXACO under the name "Jeffamin". Examples of products containing vinyl groups are the esters of glycols with corresponding acids, for example acrylic acid. Other preferred polymers are, for example, the polyesters marketed by, among others, BAYER AG under the trade name "Desmophen".

Electrolytes (II) in the context of the invention are substances which are soluble in molecular or ionic form in the polymer (I). Examples of such electrolytes are, for example, free acids or salts thereof with alkali or alkaline earth metals or organic cations. Accordingly, electrolytes include salts such as KCl, $LiNO_3$, $CH_3COONa$, $LiClO_4$, $Mg(ClO_4)_2$, KSCN, LiBr, LiI, $LiBF_4$, $LiPF_6$, $NaB(C_6H_5)_4$, $LiCF_3SO_3$, $N(C_2H_4)_4Cl$, etc.

Additives (III) according to the invention are compounds which, when mixed with (I) and (II), form a homogeneous, solid or liquid solution. For example, where a polyether is used as the polymer, masked low molecular weight polyethers, such as for example bismethylated trimethylol propane, or the esters of phthalic acid are suitable additives.

Where liquid starting materials are used, an additive (IV) (for example a crosslinking agent) is optionally added to the system before or after emulsification of the starting material and, by reaction with the functional terminal groups in the compounds (I), leads to an increase in molecular weight in the emulsion droplets or even to a reduction in the number of functional terminal groups. Depending on the type and quantity of the mixture components and additives used, viscous or solid particles are formed, retaining their spherical geometry during and after the reaction.

Where the starting material contains a glycol as component (I), difunctional or multifunctional isocyanates are preferably used as the crosslinking agent (IV). Isocyanates of different structures are marketed by BAYER AG under the name "Desmodur". Where trifunctional or higher glycols are used, it is particularly suitable to use tolylene diisocyanate as the crosslinking agent. However, the acetate, amine, benzamide, oxime and alkoxy crosslinking agents typically used in silicone chemistry may also be used for crosslinking. Radical crosslinking systems are suitable for the reaction of polymer starting materials modified by allyl or vinyl (acryl or methacryl) groups.

The EVLs according to the invention contain from 10 to 95% by weight and preferably from 40 to 70% by weight of the disperse phase (the product of the starting material and (IV).

Suitable dispersants (V) for the disperse phase are surfactants soluble in the dispersion medium which are derived, for example, from amines, imidazolines, oxazolines, alcohols, glycol or sorbitol. Polymers soluble in the dispersion medium may also be used. Suitable polymers are, for example, polymers containing 0.1 to 10% by weight N and/or OH and 25 to 83% by weight Cz. alkyl groups and having a molecular weight in the range from 5,000 to 1,000,000. The N- and OH-functional compounds in these polymers may be, for example, amine, amide, imide, nitrile, 5- to 6-membered N-containing heterocyclic rings or an alcohol and the $C_{4-24}$ alkyl groups esters of acrylic or methacrylic acid. Examples of the N- and OH-functional compounds mentioned are N,N-dimethylaminoethyl methacrylate, tert. butyl acrylamide, maleic imide, acrylonitrile, N-vinyl pyrrolidone, vinyl pyridine and 2-hydroxyethyl methacrylate. The polymeric dispersants mentioned above generally have the advantage over the low molecular surfactants that the dispersions prepared with them are more stable in regard to their sedimentation behavior.

However, polysiloxane/polyether copolymers of the type marketed, for example, by GOLDSCHMIDT AG, Essen, FRG, under the name "Tegopren" are preferably used for dispersion in silicone oil. One example of a particularly preferred dispersant for the production of an EVL are polysiloxane polyethers with a ratio by weight of ethylene oxide to propylene oxide of 49:51 which are marketed by GOLDSCHMIDT under the name "Tegopren 5830".

In addition to the polyether polysiloxanes, the reaction products of hydroxyfunctional polysiloxanes with various silanes may be used as dispersants for the production of the EVLs according to the invention. Particularly preferred dispersants from this class of substances are the reaction products of a hydroxyfunctional polysiloxane with aminosilanes.

In addition to liquid hydrocarbons, such as for example paraffins, olefins and aromatic hydrocarbons, silicone oils, such as polydimethyl siloxanes and liquid methylphenyl siloxanes, are preferably used as dispersion medium (VI) for the disperse phase. The silicone oils may be used either individually or in combinations of two or more types. The solidification point of the dispersion media is preferably lower than −30° C. while their boiling point is above 150° C. The viscosity of the oils at room 20 temperature is between 3 and 300 $mm^2/s$. The low-viscosity oils having a viscosity of 3 to 20 $mm^2/s$ are generally preferred because they provide for a lower basic viscosity of the EVLs.

To avoid sedimentation, the oil should also have a density substantially corresponding to the density of the disperse phase. For example, by using fluorine-containing siloxanes either in pure form or in admixture with other silicone oils, it is possible to produce EVLs according to the invention which show no signs of sedimentation for weeks despite a low basic viscosity.

Fluorine-containing siloxanes having the following general structure are particularly suitable for the production of non-sedimenting EVLs:

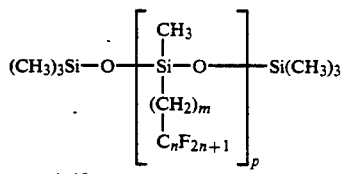

n = 1-10
m = 2-18
p = 1-5

In a typical method for the production of EVLs according to the invention, the starting material is mixed with the reactive additive or with the crosslinking agent (IV). After homogenization of the components, the mixture is dispersed in a liquid phase containing the dispersant. Shearing homogenizers, high-pressure homogenizers or ultrasound may be used here to achieve a corresponding degree of dispersion. However, dispersion should be carried out in such a way that the particle size does not exceed 200 μm. After dispersion, the product may optionally be left to react out over a prolonged period at a suitable temperature which is typically in the range from 15 to 150° C., depending on the reactivity of the crosslinking agent.

In an alternative method, the crosslinking agent is only incorporated in the dispersion on completion of the dispersion step.

After the reaction, the disperse phase may optionally be separated from the original dispersant and transferred to a new dispersion medium, irrespective of the production method.

In another method of production, the starting material with or without surfactant and the additive (IV) is sprayed to form a fine powder and the powder formed is subsequently dispersed in the liquid phase.

The EVLs thus produced were investigated in a modified rotational viscosimeter of the type described by W. M. Winslow in J. Appl. Phys. 20 (1949), pages 1137-1140.

The electrode area of the inner rotating cylinder 0.50 mm in diameter measures approx. 78 $cm^2$ and the gap width between the electrodes is 0.50 mm. For the dynamic measurements, the maximum shear rate may be adjusted to 2,640 $s^{-1}$. The maximum measuring range of the shear stress of the viscosimeter is 750 Pa. Both static and dynamic measurements are possible with this modified viscosimeter. The EVLs may be excited both with d.c. and with a.c. voltage.

Where d.c. voltage is used, it may happen with certain liquids that, in addition to the spontaneous increase in viscosity or in the yield point when the field is switched on, the solid particles are also electrophoretically deposited onto the electrode surfaces, particularly at low shear rates or in the case of static measurements. Accordingly, testing of the EVLs is preferably carried out with a.c. voltage and under dynamic shear stress. Readily reproducible flow curves are obtained in this way.

To determine electro-reactivity, a constant shear rate $0<D<2{,}640\ s^{-1}$ is adjusted and the shear stress $\tau$ is measured as a function of the electrical field strength E. With the test apparatus, it is possible to generate alternating fields up to a maximum effective field strength of 2,370 kV/m for a maximum effective current of 4 mA and a frequency of 50 to 550 Hz. However, the measurement is preferably carried out at 50 Hz because the total current is then at its lowest so that the electrical power required is also at its lowest. The flow curves obtained are as shown in FIG. 1. It can be seen that the shear stress $\tau$ shows a parabolic increase at low field strengths and a linear increase at higher field strengths. The gradient S of the linear part of the curve is apparent from FIG. 1 and is expressed in Pa·mm/kV. The threshold value $E_o$ of the electrical field strength is determined from the point of intersection between the straight line S and the straight line $\tau=\tau_o$ (shear stress without an electrical field) and is expressed in kV/m. The increase in the shear stress $\tau(E)-\tau_o$ in the electrical field $E>E_o$ may be calculated in accordance with the following equation:

$$\tau(E)-\tau_o=S(E-E_o).$$

The following relation thus applies to the relative increase in viscosity, $V_r(E)$, which is obtained by application of an electrical field having a strength E:

$$V_r(E)=\tau_o(E)/\tau_o=(\tau_o+S(E-E_o))/\tau_o.$$

The relative increase in viscosity determines the switching behavior of an EVL in practice and is therefore an important characteristic along with the absolute effect S.

EXAMPLES

In the following Examples, Comparison Examples 1 to 5 correspond to the prior art. The EVLs described in Comparison Examples 1 to 3 contain as their disperse phase water-containing polymers with free or neutralized acid groups attached thereto by covalent bonds. Comparison Examples 1 to 3 are based on Examples 1, 2 and 7 of DE 2 820 494 C2. The liquids described in these Examples, which are representative of the patent, have good electroviscous effects, but show high plastic viscosity so that the relative effect is distinctly weaker.

The EVLs described in Comparison Examples 4 and 5 contain as their disperse phase water-free aluminium particles having different coatings. They are taken from Examples 1 and 4 of JP 64-6093. The described EVLs have poor sedimentation properties due to the density and size of the disperse particles (>20 μm).

Examples 1 and 10 relate to electroviscous liquids according to the invention. In all the described samples, the average particle diameter is approximately 2 μm. The maximum particle diameter is 6 μm. The samples were measured at a temperature of 60° C.

The electroviscous properties of the EVLs according to the invention and their viscosity are shown in Table 1. The low basic viscosity of the liquids and the resulting high relative electroviscous effect are particularly emphasized.

Figure 2:
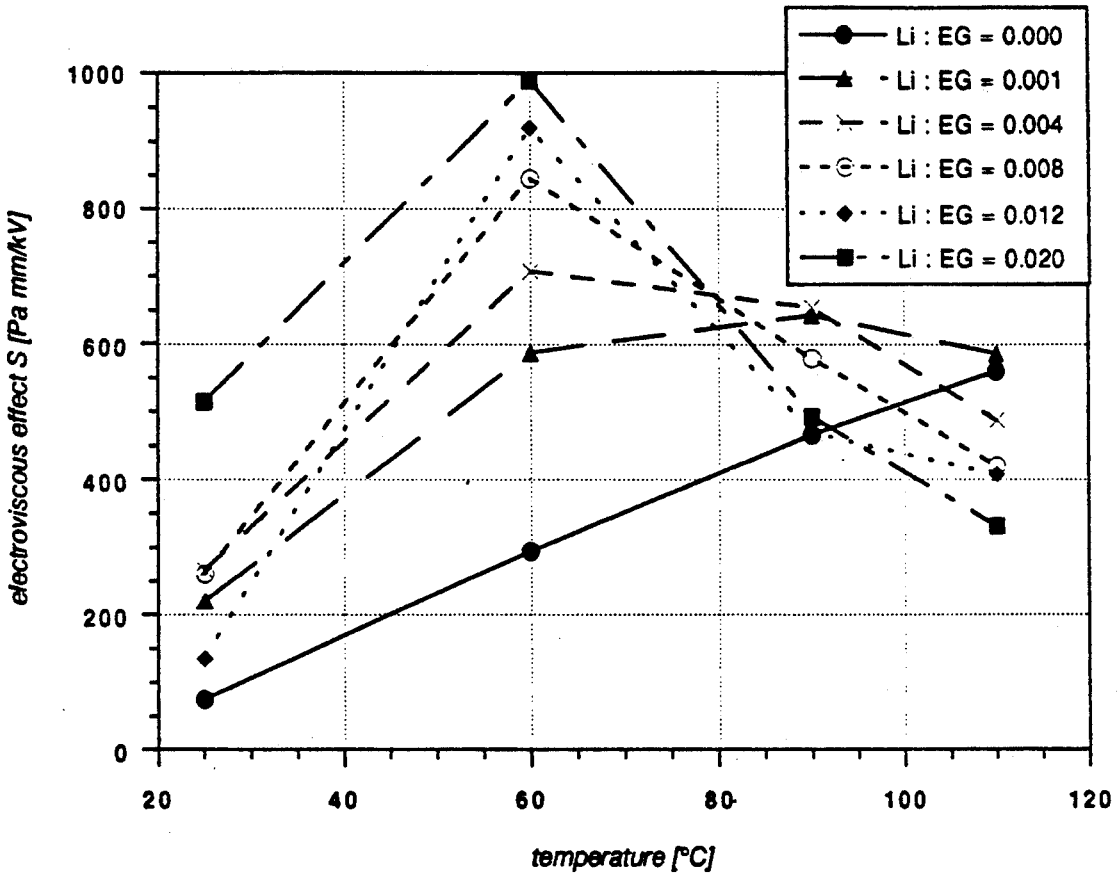

The correlation between the electroviscous effect S and the molar Li component, based on the ethylene oxide content, is shown in the form of a graph in FIG. 2 for $LiNO_3$-containing EVLs produced on the basis of crosslinked glycols (Examples 1 to 6).

Figure 3:
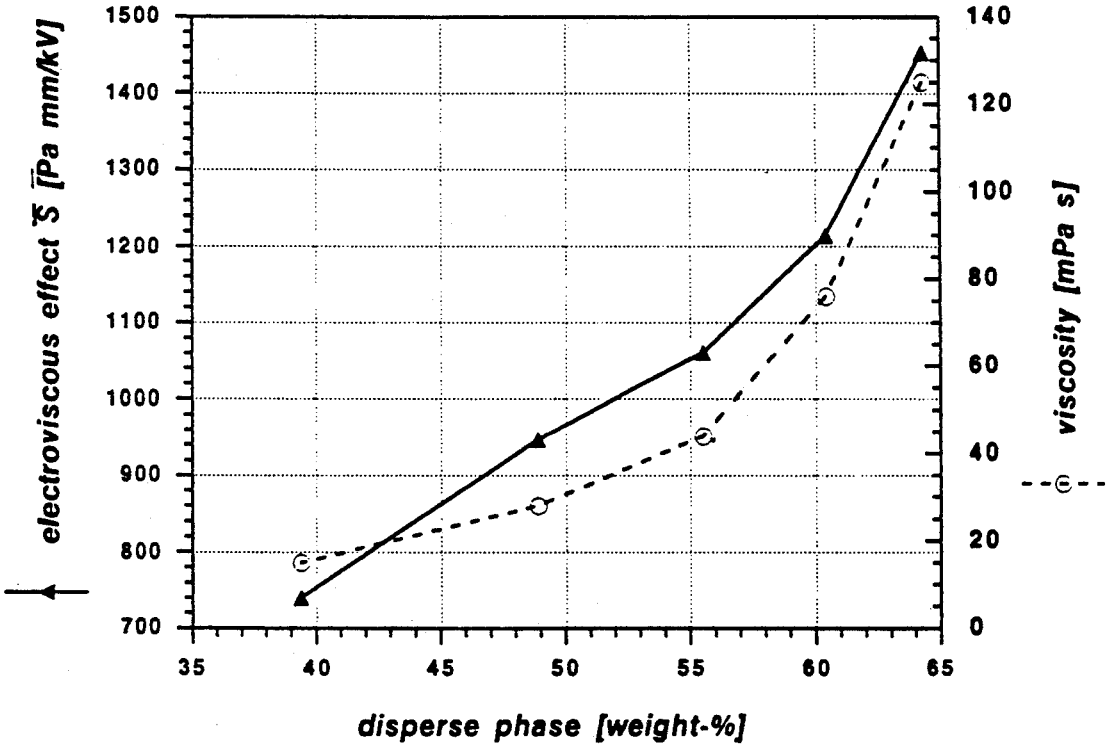

FIG. 3 shows the trend of the electroviscous effect S and of the viscosity of an EVL produced in accordance with Example 9 at a shear rate of 1,000 $s^{-1}$ as a function of the concentration by weight of the disperse phase. It can be seen that the liquid according to the invention is characterized by low viscosity despite high solids concentrations.

EXAMPLES

| | | |
|---|---|---|
| Dispersion medium | Polydimethyl siloxane (silicone oil) | |
| | Viscosity at 25° C. | 5 $mm^2/s$ |
| | Density at 25° C. | 0.9 $g/cm^3$ |
| | Dielectric constant $\epsilon_4$ acc. to DIN 53483 at 0° C./50 Hz | 2.8 |
| Dispersed phase | Trifunctional polyethylene glycol, molecular weight 675, prepared by ethoxylation of trimethylol propane | |
| Dispersant | Reaction product of 100 parts by weight of an OH-terminated polydimethyl siloxane having a molecular weight of 18,200 and 1 part by weight aminopropyl triethoxysilane | |
| Crosslinking agent | Tolylene diisocyanate (TDI) | |

COMPARISON EXAMPLE 1

Example 1 of DE 2 820 494 C2: 30% by volume dispersion of a divinylbenzene-crosslinked polyacrylic acid in a polychlorinated diphenyl fraction. The electroviscous effect at 30° C. was between 975 and 1,070 Pa·mm/kV, depending on the water content (1.3–5% by weight). The plastic viscosity was 220 mPa.s. $V_r$ (3,000=10.7–12.6).

COMPARISON EXAMPLE 2

Example 2 of DE 2 830 494 C2: 30% by volume dispersion of a divinylbenzene-crosslinked methacrylic acid in a polychlorinated diphenyl fraction. For a water content of <6.2% by weight, the electroviscous effect at 30° C. measured 690 Pa·mm/kV. The plastic viscosity measured 260 mPa.s $V_r$ (3,000)=8.1.

COMPARISON EXAMPLE 3

Example 7 of DE 2 820 494 C2: 30% by volume dispersion of lithium/chromium polymethacrylate in a polychlorinated diphenyl fraction. In ambient humidity, the electroviscous effect at 30° C. measured 1,960 Pa·mm/kV. The plastic viscosity measured 236 mPa.s V (3,000)=17 9.

COMPARISON EXAMPLE 4

Example 1 of JP-OS 64-6093: 20% by volume dispersion of an aluminium-oxide-coated aluminium powder in TRIMEX T-08. For a.c. voltage of 60 Hz, the electroviscous effect measured 327 Pa·mm/kV.

COMPARISON EXAMPLE 5

Example 4 of JP-OS 64-6093: 20% by volume dispersion of an aluminium-oxide-coated aluminium powder in TRIMEX T-08. For an a.c. voltage of 60 Hz, the electroviscous effect measured 371 Pa mm/kV.

COMPARISON EXAMPLE 6

In a glass beaker having a nominal volume of 100 ml, 0.6 g of the dispersant are dissolved in 20 g of the dispersion medium. In a second glass beaker, 17.5 g of the glycol are mixed with 6.79 g of the crosslinking agent. For a quantitative reaction, this quantity of crosslinking agent results in stoichiometric reaction of the hydroxyl groups in the glycol and thus corresponds to an OH conversion of 100 mol-%. The reactive mixture of glycol and crosslinking agent is emulsified in the dispersant solution immediately after homogenization with a rotor/stator shearing homogenizer (Ultra-Turrax T25, manufactured by IKA Labortechnik). At a rotational speed of the rotor of 10,000 r.p.m., the emulsification time is 2 minutes. The samples were then fully reacted for 15 hours at 90° C.

EXAMPLE 1

An EVL was prepared in the same way as described in Comparison Example 6, except that 0.0273 g solid anhydrous $LiNO_3$ was dissolved in the glycol before further processing. This corresponds to a molar ratio of Li to EO of 1:1,000, based on the number of ethylene oxide units in the glycol.

EXAMPLE 2

Preparation as in Example 1, but with 0.109 g $LiNO_3$ (Li:EO ratio 4:1,000).

EXAMPLE 3

Preparation as in Example 1, but with 0.218 g $LiNO_3$ (Li:EO ratio 8:1,000).

EXAMPLE 4

Preparation as in Example 1, but with 0.328 g $LiNO_3$ (Li:EO ratio 12:1,000).

EXAMPLE 5

Preparation as in Example 1, but with 0.564 g $LiNO_3$ (Li:EO ratio 20:1,000).

EXAMPLE 6

Preparation as in Example 1, except that 1.253 g nonanoic acid was used as electrolyte (H:EO ratio 2:1,000).

EXAMPLE 7

Preparation as in Example 1, except that 1.313 g tetraethyl ammonium chloride was used as electrolyte ($N(CH_3CH_2)_4$:EO ratio 2:1,000).

EXAMPLE 8

Preparation as in Comparison Example 7, but with 0.0273 g $LiNO_3$ (Li:EO ratio 2:1,000).

EXAMPLE 9

3.9 g $LiNO_3$ were dissolved in 305.46 g glycol. The resulting solution was mixed with 116.4 g crosslinking agent and dispersed in a solution of 6 g dispersant in 200 g silicone oil and further processed as in Comparison Example 6. The solids content of this EVL was adjusted to between 39 and 64% by addition of silicone oil. The trend of the electroviscous effect S and the viscosity of the EVL at a shear rate of 1,000 $s^{-1}$ is shown in FIG. 3.

TABLE 1

| | Properties | | | |
|---|---|---|---|---|
| EVL acc. to | $E_o$ kV/m | S Pa · mm/kV | V(O) mPa.S (1) | $V_r$(3,000) (2) |
| Comp. Ex. 6 | 1384 | 295 | 59 | 9.1 |
| Example 1 | 738 | 587 | 63 | 23.5 |
| Example 2 | 536 | 707 | 59 | 30.5 |
| Example 3 | 536 | 845 | 51 | 41.8 |
| Example 4 | 560 | 920 | 40 | 57.1 |
| Example 5 | 400 | 990 | 60 | 43.9 |
| Example 6 | 1228 | 405 | 51 | 15.0 |
| Example 7 | 244 | 841 | 64 | 37.2 |
| Example 8 | 264 | 190 | 36 | 15.4 |

It is understood that the specification and examples are illustrative but not limitative of the present invention and that other embodiments within the spirit and scope of the invention will suggest themselves to those skilled in the art.

What is claimed is:

1. An electroviscous liquid free of water comprising
   a) 40 to 70% by weight of a particulate material selected from the group consisting of linear polyethers, branched polyethers, crosslinked polyethers thereof, polyethylene adipate, polyethylene succinate and polyphosphazene, wherein an electrolytic free acid or alkali, alkaline earth metal or organic cation salt thereof, said acid or salt being soluble in the particulate material in molecular or ionic form, is dissolved in the particulate material,
   b) a liquid non-aqueous dispersion medium, and
   c) an effective amount of dispersant that is different from a) and b).

2. An electroviscous liquid according to claim 1 wherein the particulate material is selected from the group consisting of linear polyethers, branched polyethers and oligomers.

3. An electroviscous liquid according to claim 1 wherein the dispersion medium is a silicone oil.

4. An electroviscous liquid according to claim 1 wherein the dispersion medium is a fluorine-containing siloxane.

5. An electroviscous liquid according to claim 1 wherein the dispersion medium is a hydrocarbon.

6. An electroviscous liquid according to claim 1 wherein the dispersant is a polysiloxane/polyether copolymer.

7. An electroviscous liquid according to claim 1 wherein the dispersant is an aminofunctional alkoxypolysiloxane or acetoxypolysiloxane.

* * * * *

UNITED STATES PATENT AND TRADEMARK OFFICE

CERTIFICATE OF CORRECTION

PATENT NO. : 5,268,118

DATED : December 7, 1993

INVENTOR(S) : Bloodworth, et al.

It is certified that error appears in the above-indentified patent and that said Letters Patent is hereby corrected as shown below:

| | |
|---|---|
| Col. 10, lines 7-8 | After " polyethers " insert -- and oligomers -- |
| Col. 10, line 20 | Delete " . " and substitute -- thereof or the reaction product of said polyether or oligomer with a cross-linking agent. -- |

Signed and Sealed this

Eighth Day of July, 1997

Bruce Lehman

*Attest:*

BRUCE LEHMAN

*Attesting Officer*

*Commissioner of Patents and Trademarks*